US010130540B2

(12) United States Patent
Won et al.

(10) Patent No.: US 10,130,540 B2
(45) Date of Patent: Nov. 20, 2018

(54) BODY LIFTING DEVICE FOR BED

(71) Applicant: Korea Institute of Industrial Technology, Chungcheongnam-do (KR)

(72) Inventors: Byeong Hee Won, Yongin-si (KR); Jong Hyun Kim, Seongnam-si (KR); Chang Ki Lee, Seongnam-si (KR); Woo Sang Sim, Gwangmyeong-si (KR)

(73) Assignee: KOREA INSTITUTE OF INDUSTRIAL TECHNOLOGY, Chungcheongnam-Do (KR)

( * ) Notice: Subject to any disclaimer, the term of this patent is extended or adjusted under 35 U.S.C. 154(b) by 0 days.

(21) Appl. No.: 15/512,336

(22) PCT Filed: Sep. 18, 2015

(86) PCT No.: PCT/KR2015/009822
§ 371 (c)(1),
(2) Date: Mar. 17, 2017

(87) PCT Pub. No.: WO2016/043550
PCT Pub. Date: Mar. 24, 2016

(65) Prior Publication Data

US 2017/0296413 A1 Oct. 19, 2017

(30) Foreign Application Priority Data

Sep. 19, 2014 (KR) ..... 10-2014-0124828
Sep. 18, 2015 (KR) ..... 10-2015-0132220

(51) Int. Cl.
*A61G 7/10* (2006.01)
*A61G 7/015* (2006.01)
*A61G 7/07* (2006.01)

(52) U.S. Cl.
CPC ..... *A61G 7/1015* (2013.01); *A61G 7/015* (2013.01); *A61G 7/07* (2013.01); *A61G 7/1017* (2013.01);
(Continued)

(58) Field of Classification Search
CPC .. A61G 7/1009; A61G 7/1019; A61G 7/1048; A61G 7/1057; A61G 7/1015;
(Continued)

(56) References Cited

U.S. PATENT DOCUMENTS 3,612,042 A * 10/1971 Fry ..... A61H 1/02 482/148
4,194,253 A * 3/1980 Ullven ..... A61G 7/1015 5/84.1
(Continued)

FOREIGN PATENT DOCUMENTS

JP 48101488 U 11/1973
JP 05168657 A 7/1993
(Continued)

OTHER PUBLICATIONS

Int'l Search Report dated May 30, 2016 in Int'l Applicatin No. PCT/KR2015/009822.

*Primary Examiner* — Peter M. Cuomo
*Assistant Examiner* — Rahib T Zaman
(74) *Attorney, Agent, or Firm* — Cantor Colburn LLP

(57) ABSTRACT

A body lifting device for a bed is provided with a support unit, having a predetermined height, connected to a fixing part of a bed. A movable bed part adjusts an angle between the fixing and movable parts. A driving force transfer member of the device is connected to the movable part at one end, the other end extending toward the fixing part, and has a support point therebetween supported by the support unit. A length between the support point and the other end
(Continued)

varies depending on an angle adjustment of the movable part. A lifting unit of the device supports a portion of a user's body, and is connected to the other end of the driving force transfer member. The lifting unit selectively lifts up the user's body depending on movement of the driving force transfer member, which is caused by adjusting an angle of the movable part.

17 Claims, 17 Drawing Sheets

(52) U.S. Cl.
CPC ..... *A61G 7/1044* (2013.01); *A61G 7/1051* (2013.01)

(58) Field of Classification Search
CPC ..... A61G 7/015; A61G 7/07; A61G 7/1017; A61G 7/1044; A61G 7/1051; A61G 7/0755; A61G 7/1023; A61G 7/1098; A61G 7/1061
See application file for complete search history.

(56) References Cited

U.S. PATENT DOCUMENTS 4,502,169 A * 3/1985 Persson ..... A61G 7/001 192/45.017
4,843,665 A * 7/1989 Cockel ..... A61G 7/0005 5/88.1
4,887,325 A * 12/1989 Tesch ..... A61G 7/1015 5/84.1
5,161,267 A * 11/1992 Smith ..... A61G 7/1015 5/612
5,177,822 A * 1/1993 Kassai ..... A61G 7/1011 5/612
5,327,593 A * 7/1994 Burnett ..... A61G 7/001 5/83.1
5,406,658 A * 4/1995 Olkkonen ..... A61G 7/005 5/83.1
5,539,941 A * 7/1996 Fuller ..... A61G 7/0005 5/85.1
5,673,443 A * 10/1997 Marmor ..... A61G 7/001 5/85.1
6,295,666 B1 * 10/2001 Takaura ..... A61G 7/001 5/611
6,629,323 B2 * 10/2003 Sverdlik ..... A61G 7/1015 5/81.1 C
6,662,388 B2 * 12/2003 Friel ..... A61G 7/1015 5/81.1 HS
6,880,186 B2 * 4/2005 Johansson ..... A61G 7/015 5/81.1 R
7,434,278 B2 * 10/2008 White ..... A61G 7/1015 5/81.1 HS
8,397,320 B2 * 3/2013 Capaldi ..... A61G 7/1015 5/83.1
8,407,831 B2 * 4/2013 White ..... A61G 7/1017 212/901
8,430,910 B2 * 4/2013 Yen ..... A61G 7/015 602/32
8,468,623 B2 * 6/2013 Patterson ..... A61G 7/1019 297/330
8,572,774 B1 * 11/2013 Osika ..... A61H 1/0255 5/662

FOREIGN PATENT DOCUMENTS

JP 0664637 U 9/1994
JP 3192584 B2 7/2001
JP 2010172630 A 8/2010
KR 20130002297 U 4/2013
KR 101345273 B1 12/2013

* cited by examiner

BODY LIFTING DEVICE FOR BED

CROSS-REFERENCE TO RELATED APPLICATION

This application is a Section 371 of International Application No. PCT/KR2015/009822, filed Sep. 18, 2015, which was published in the Korean language on Mar. 24, 2016, under International Publication No. WO 2016/043550 A2, the disclosure of which is incorporated herein by reference.

TECHNICAL FIELD

The present invention relates to a body lifting device for a bed and, more particularly, to a body lifting device for a bed, which may lift up at least a portion of a body of a user in conjunction with adjusting of an angle of a bed, the angle of which may be adjusted.

BACKGROUND ART

Various convenience functions are frequently provided to a medical bed for a patient, an old person and the like, whose behavior is inconvenient. That is, because the patient, the old person and the like are difficult to move their body, the medical bed provides convenience functions for assisting behavior of a user.

Among such convenience functions, a function of lifting up a portion of a body of the user temporarily or for a long time in various situations in which clothes of the patient and the old person are replaced or urine and excrement of the patient and the old person are processed is required.

In the related art, to allow a carer or a protector to replace clothes of a person to be cared or a person to be protected, a body of the person to be cared or the person to be protected is lifted up by the carer or the protector himself/herself, and the clothes are then replaced. In this process, there is a problem in that a very large effort is consumed.

In particular, when strength of the carer or the protector is weak, this operation is almost important, and accordingly, it is necessary to rotate the body of the person to be cared or the person to be protected leftward/rightward. In this process, there is a problem in that a case where the body of the person to be cared or the person to be protected is damaged sometimes occurs or it is difficult to perform a smooth goal operation.

To solve such a problem, although a lifting device for lifting up a body of the person to be cared or the person to be protected using separate power is developed, the conventional lifting device has problems in that because a volume thereof is large, use is inconvenient and it is difficult to use the lifting device in a narrow space. Further, because such a lifting device necessarily consumes additional electric power or energy, efficiency thereof greatly deteriorates.

Thus, a method for solving the above problems is required.

DISCLOSURE

Technical Problem

The present invention is conceived to solve problems of the related art, and an aspect of the present invention is to provide a body lifting device for a bed, of which an occupation area is minimized and of which use is convenient.

Further, another aspect of the present invention is to provide a body lifting device for a bed, which does not require separate power.

Problems of the present invention are not limited to the above-described problems, and other not-described problems could be clearly understood by those skilled in the art with reference to the following descriptions.

Technical Solution

To achieve the above aspect, a body lifting device for a bed according to the present invention includes: a support unit connected to a fixing part of a bed including the fixing part and a movable part formed to adjust an angle between the fixing part and the movable part, and having a predetermined height; a driving force transfer member having one end connected to the movable part, the other end extending toward the fixing part and a support point at which at least a portion between the one end and the other end of the driving force transfer member is supported by the support unit, wherein a length between the support point and the other end is varied depending on adjusting of an angle of the movable part; and a lifting unit formed to support at least a portion of a body of a user, connected to the other end of the driving force transfer member, and configured to selectively lift up the body of the user depending on movement of the driving force transfer member, which is caused by adjusting an angle of the movable part.

Further, the support unit includes a pair of vertical bars provided at both sides of the fixing part, respectively, and extending vertically, and a horizontal bar configured to connect upper ends of the pair of vertical bars to each other and having a support point configured to support the driving force transfer member.

Further, the horizontal bar has an adjustable length.

Further, the horizontal bar includes first bases, and first slides formed to be relatively slidable with respect to the first bases.

Further, the horizontal bar includes a rotation part having the support point and formed rotatably.

Further, the support unit includes a first connection part configured to fix the support unit to the fixing part.

Further, the body lifting device further includes an auxiliary fixing unit fixed to the movable part, having a predetermined height and connected to the one end of the driving force transfer member on an upper side of the auxiliary fixing unit.

Further, the auxiliary fixing unit has an adjustable length.

Further, the auxiliary fixing unit includes a second base, and a second slide provided above the second base, formed to be vertically slidable with respect to the second base, and connected to the one end of the driving force transfer member at an upper end of the second slide.

Further, the auxiliary fixing unit includes a second connection part configured to fix the auxiliary fixing unit to the movable part.

Further, the other end of the driving force transfer member is branched into two parts, and the lifting unit includes a support member having a predetermined area and configured to support at least a portion of the body of the user, and a pair of fastening parts formed at both ends of the support member and connected to the branched ends of the driving force transfer member, respectively.

Further, at least one of the pair of fastening parts is attached/detached to/from the branched ends of the driving force transfer member.

Further, the support member has an opened area formed by opening an area corresponding to an anus of the body of the user.

Further, the support unit is rotatably formed in the fixing part and is folded toward a circumference of the fixing part.

Further, a body lifting device for a bed according to the present invention includes: a support unit installed in a bed including a fixing part and a movable part formed to adjust an angle between the fixing part and the movable part, and including a vertical part having a predetermined height and having an opened hole extending vertically, a horizontal part coupled to an upper portion of the vertical part, and a movable part provided in the vertical part to be vertically movable; a driving force transfer member having one end connected to the movable part and being in contact with the movable part by passing through the opened hole and having a support point supported by the horizontal part, wherein a length between the support point and the other end is varied depending on adjusting of an angle of the movable part; and a lifting unit formed to support at least a portion of a body of a user, connected to the other end of the driving force transfer member, and configured to selectively lift up the body of the user depending on movement of the driving force transfer member, which is caused by adjusting the angle of the movable part.

The body lifting device further includes a support part configured to support the horizontal part, and the vertical part includes a first vertical part and a second vertical part spaced apart from the first vertical part by a predetermined distance to define an opened hole between the first vertical part and the second vertical part.

Advantageous Effects

A body lifting device for a bed for solving the above problems according to the present invention has the following effects.

First, there are advantages in that an occupation area of a device for lifting up a body of a user is minimized, so that restraint of a space is minimized, and use thereof is convenient.

Second, there is an advantage in that separate power is not required so that consumption of additional electric power or energy is not required.

Third, there is an advantage in that the present invention may be applied even to a pre-manufactured bed.

Effects of the present invention are not limited to the above-described effects, and other not-mentioned effects could be clearly understood by those skilled in the art with reference to the appended claims.

BEST MODE FOR THE INVENTION

Figure 1:
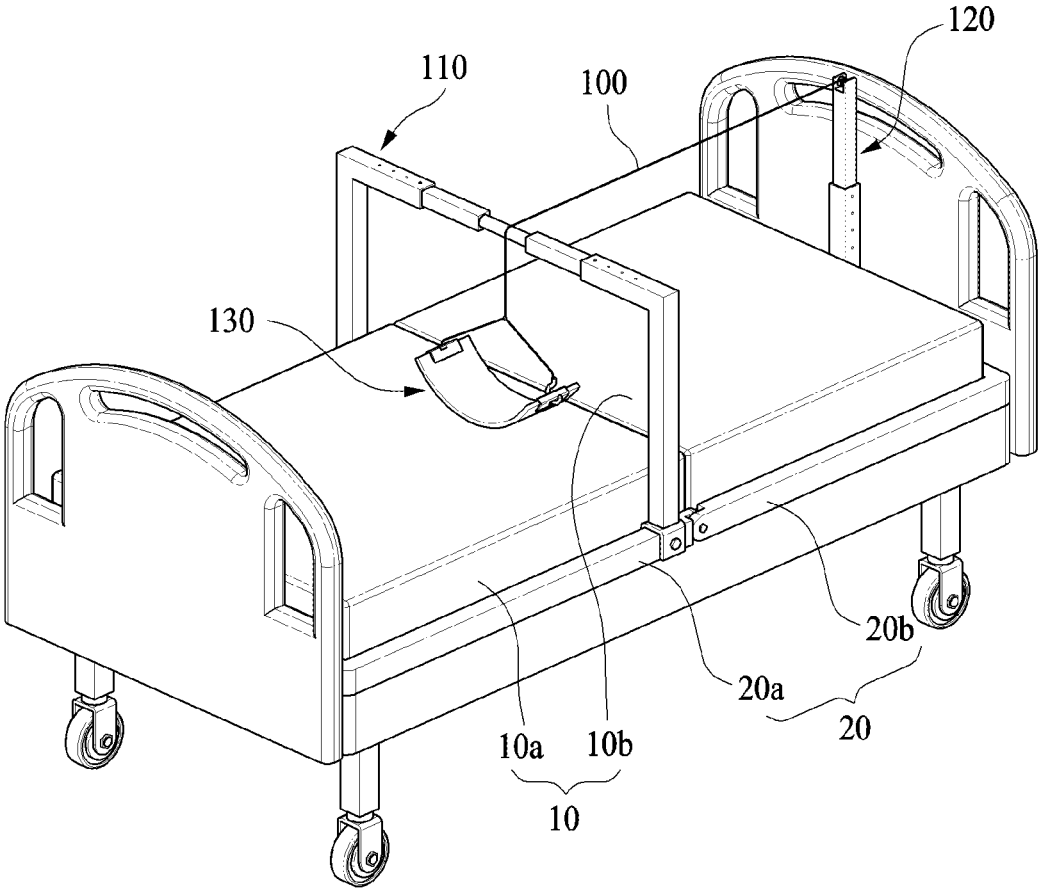
FIG. 1 is a perspective view illustrating an entire shape of a body lifting device for a bed according to a first embodiment of the present invention.

Hereinafter, exemplary embodiments of the present invention, which may implement the aspects of the present invention in detail, will be described with reference to the accompanying drawings. In description of the present embodiment, the same elements are designated by the same names and the same reference numerals, and additional description according thereto will be omitted.

FIG. 1 is a perspective view illustrating an entire shape of a body lifting device for a bed according to a first embodiment of the present invention.

First, a bed 10 to which a body lifting device for a bed is applied includes a fixing part 10*a* and a movable part 10*b* formed to adjust an angle between the fixing part 10*a* and the movable part 10*b*. That is, the movable part 10*b* are rotatable with respect to the fixing part 10*a*, has a shape of a general bed in a completely unfolded state, and supports an upper body of a user to lift up the upper body in a standing state, through rotation.

In particular, in the present embodiment, the fixing part 10*a* and the movable part 10*b* include a frame 20 below a matrix. Here, the frame 20 includes fixing frames 20*a* corresponding to the fixing part 10*a* and movable frames 20*b* corresponding to the movable part 10*b*.

Further, the body lifting device for a bed according to the present invention is implemented such that driving force for adjusting an angle of the movable part 10*b* may be used.

The body lifting device for a bed according to the present invention includes a support unit 110, a driving force transfer member 100 and a lifting unit 130. Further, in the present embodiment, the body lifting device for a bed further includes an auxiliary fixing unit 120.

The support unit 110 is connected to a side of the fixing part 10*a* of the bed and is formed to have a predetermined height. In particular, in the present embodiment, the support unit 110 is fixed to the fixing frames 20*a* of the fixing part 10*a*.

The driving force transfer member 100 has one end connected to the movable part 10*b* and the other end extending toward the fixing part 10*a*. Here, a support point at which at least a portion between the one end and the other end of the driving force transfer member 100 is supported by the support unit 110 is formed.

That is, the driving force transfer member 100 extends from the movable part 10*b*, is supported by the support unit 110, and has the other end spaced downward apart from the support point of the support unit 110.

Further, the driving force transfer member 100 may be implemented in various forms such as a wire and a strap.

The lifting unit 130 is formed to support at least a portion of the body of the user and is connected to the other end of the driving force transfer member 100. Further, the body of the user is selectively lifted up depending on movement of the driving force transfer member 100, which is caused by adjusting the angle of the movable part 10*b*.

The auxiliary fixing unit 120 is fixed to the movable part 10*b* and is formed to have a predetermined height. Further, the auxiliary fixing unit 120 is connected to the one end of the driving force transfer member 100 on an upper side thereof.

That is, the auxiliary fixing unit 120 is a component configured to allow the one end of the driving force transfer member 100 to be maintained at a predetermined height, and accordingly, a situation in which the user feels inconvenience by the driving force transfer member 100 while lying on the bed may be prevented. Further, in the present embodiment, the auxiliary fixing unit 120 is fixed to the movable part 10*b* and the movable frames 20*b*.

However, it is apparent that depending on a design, unlike the present embodiment, the auxiliary fixing unit 120 is omitted, and the driving force transfer member 100 may be directly connected to the movable part 10*b*.

Hereinabove, components of the present invention have been schematically described, and detailed structures of the components will be described below. Further, a detailed process in which the present invention is driven will be described below.

Figure 2:
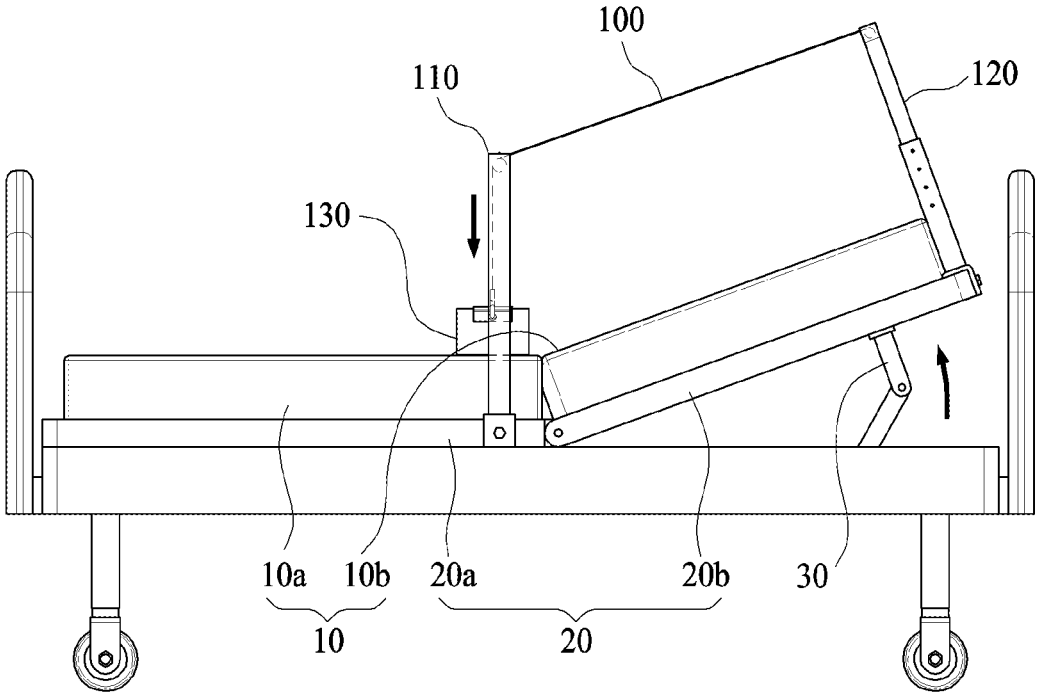
FIG. 2 is a side view illustrating a state in which a lifting unit is lowered as a movable part of a bed stands up, in the body lifting device for a bed according to the first embodiment of the present invention.
Figure 3:
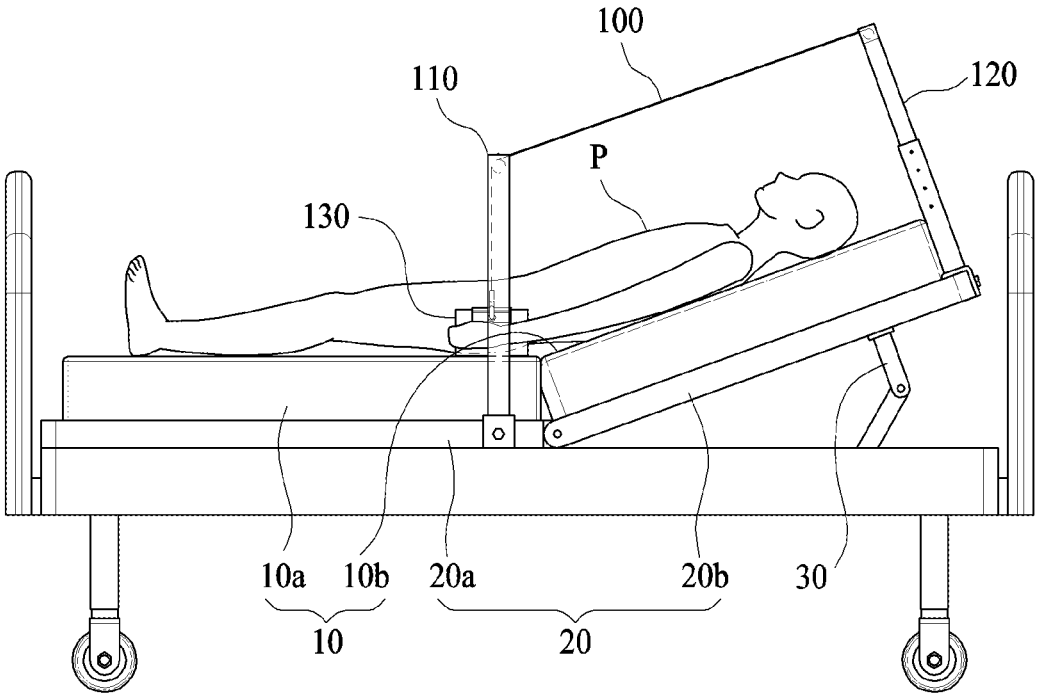
FIG. 3 is a side view illustrating a state in which a user is seated on the lifting unit, in the body lifting device for a bed according to the first embodiment of the present invention.
Figure 4:
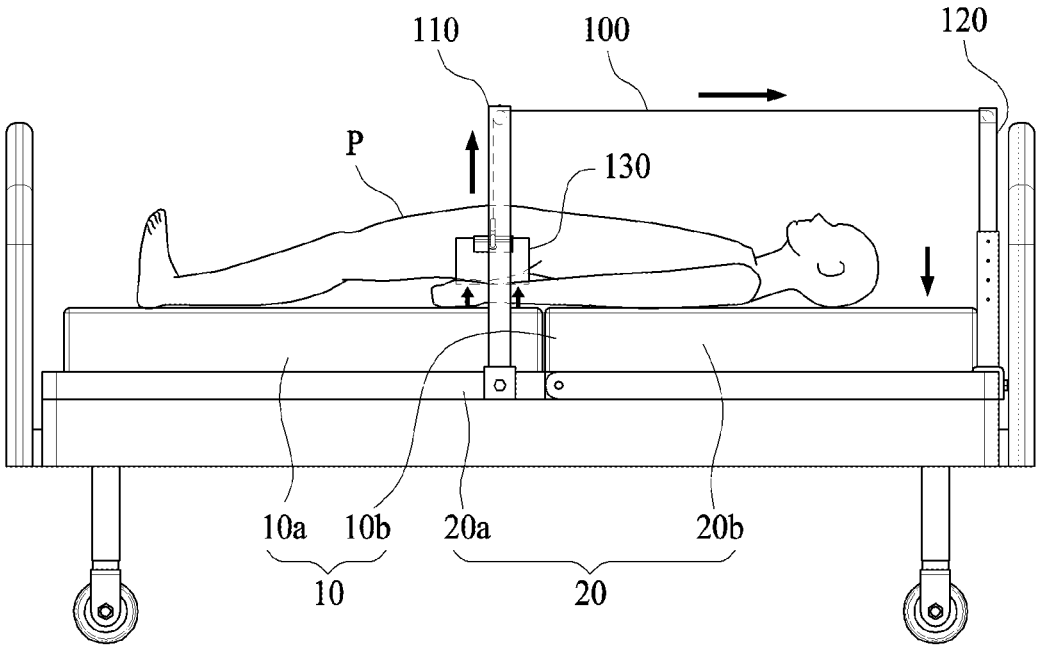
FIG. 4 is a side view illustrating a state in which as the movable part of the bed is restored, the lifting unit is lifted up so that a portion of a body of a user is lifted up, in the body lifting device for a bed according to the first embodiment of the present invention.

FIG. 2 is a side view illustrating a state in which the lifting unit 130 is lowered as the movable part 10*b* of the bed stands up, in the body lifting device for a bed according to the first embodiment of the present invention. Further, FIG. 3 is a side view illustrating a state in which a user P is seated on the lifting unit 130 in the body lifting device for a bed according to the first embodiment of the present invention, and FIG. 4 is a side view illustrating a state in which as the movable part 10*b* of the bed is restored, the lifting unit 130 is lifted up, so that a portion of the body of the user P is lifted up, in the body lifting device for a bed according to the first embodiment of the present invention.

First, as illustrated in FIG. 2, a distance between the support point of the support unit 110 and the other end of the driving force transfer member 100 is varied depending on adjustment of the angle of the movable part 10*b*.

In detail, in the present embodiment, when the movable part 10*b* stands up by adjusting the angle of the movable part 10*b* by a driving frame 30 configured to transfer driving force of a driving part, the one end of the driving force transfer member 100 and the support point become closer to each other, and thus, the other end of the driving force transfer member 100 is lowered.

Thus, the lifting unit 130 connected to the other end of the driving force transfer member 100 is also lowered and is seated on the fixing part 10*a* such that the body of the user P may be easily seated thereon. In this state, the user P may seat at least a portion of the body thereof on the lifting unit 130, as illustrated in FIG. 3.

Although in the present embodiment, the lifting unit 130 has a shape corresponding to a hip of the user P to support the hip of the user P, the present invention is not limited thereto. Further, it is apparent that the lifting unit 130 may have various shapes depending on supported portions of the body.

Thereafter, as illustrated in FIG. 4, when the movable part 10*b* is restored to an original location thereof, the one end of the driving force transfer member 100 and the support point become farther away from each other. Thus, the other end of the driving force transfer member 100 is lifted up and the lifting unit 130 is also lifted up, so that the body of the user P is lifted up.

As described above, in the present invention, the driving force transfer member 100 is moved using a scheme such as a pulley, so that at least a portion of the body of the user P may be lifted up. Hereinbelow, structures of the components of the present invention will be described in more detail.

Figure 5:
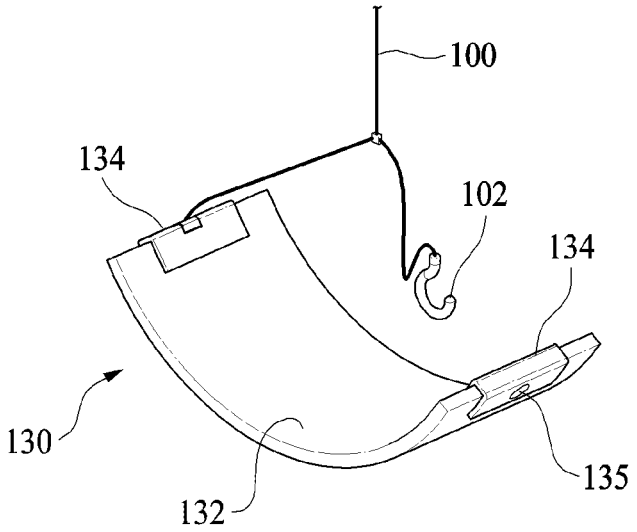
FIG. 5 is a perspective view illustrating a structure of the lifting unit, in the body lifting device for a bed according to the first embodiment of the present invention.

FIG. 5 is a perspective view illustrating a structure of the lifting unit 130, in the body lifting device for a bed according to the first embodiment of the present invention.

As illustrated in FIG. 5, in the present embodiment, the other end of the driving force transfer member 100 is branched into two parts.

Further, the lifting unit 130 is formed to have a predetermined area, and includes a support member 132 configured to support at least a portion of the body of the user and a pair of fastening parts 124 connected to the branched ends of the driving force transfer member 100, respectively.

Here, at least one of the pair of fastening parts 134 may be formed to be attachable/detachable to/from the branched ends of the driving force transfer member 100. In the present embodiment, a fastening hook 102 having a shape of a ring is formed on one of the branched ends of the driving force transfer member 100, and a fastening hole 135 into which the fastening hook 102 is inserted is formed in a fastening part 134 of the support member 132, which corresponds to the fastening hook 102.

In this way, as the fastening part 134 may be selectively separated from the driving force transfer member 100, the body of the user may be seated on the fastening member 132.

Meanwhile, in the present embodiment, only one fastening part is detachably formed. Unlike this, it is apparent that the both fastening parts 134 may be detachably formed, and a fastening structure thereof may be variously configured in different forms from that of the present embodiment.

Figure 6:
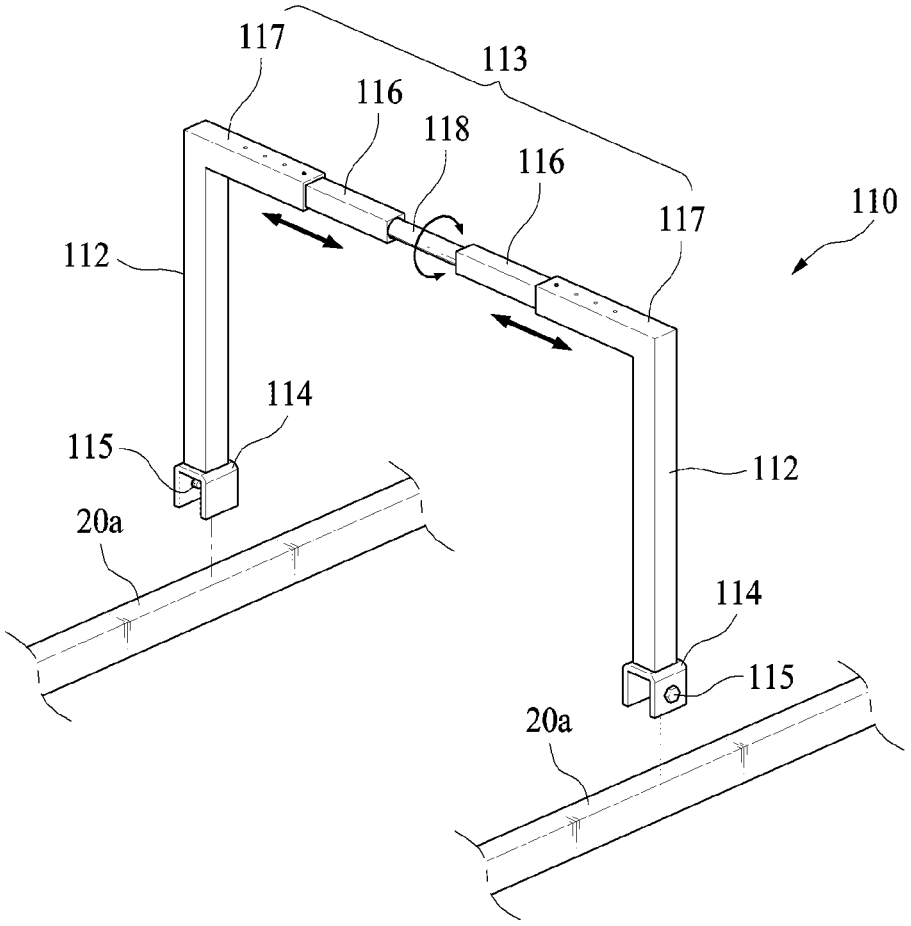
FIG. 6 is a perspective view illustrating a structure of a support unit, in the body lifting device for a bed according to the first embodiment of the present invention.

FIG. 6 is a perspective view illustrating a structure of the support unit 110, in the body lifting device for a bed according to the first embodiment of the present invention.

As illustrated in FIG. 6, the support unit 110 according to the present embodiment is provided on both sides of the fixing part of the bed, and includes a pair of vertical bars 112 vertically extending and a horizontal bar 113 configured to connect upper ends of the pair of vertical bars 112 to each other and having the support point configured to support the driving force transfer member.

That is, the horizontal bar 113 is spaced apart from an upper surface of the bed by a predetermined height. Further, in particular, in the present embodiment, the horizontal bar 113 has an adjustable length.

The horizontal bar 113 having such a structure includes first bases 117 and first slides 116 formed to be relatively slidable with respect to the first bases 117, in more detail. That is, the entire length of the horizontal bar 113 may be adjusted by sliding the first slides 116, and accordingly, the present invention may be easily applied to various beds having different widths.

Further, in the present embodiment, the horizontal bar 113 includes a pair of bases 117 and first slides 116.

Further, the horizontal bar 113 further includes a rotation part 118 having the above-described support point of the driving force transfer member and formed rotatably. In the present embodiment, the rotation part 118 is rotatably provided between the pair of first slides 116, so that friction when the driving force transfer member is moved forward/rearward may be minimized.

Meanwhile, the support unit 110 further includes first connection parts 114 configured to fix the support unit 110 to the fixing part of the bed. In the present embodiment, the first connection parts 114 are provided below the vertical bars 112, and are coupled to the fixing frames 20*a* of the fixing part, respectively.

In more detail, the first connection parts 114 are formed to surround the fixing frames 20*a*, respectively, and are fixed to the entire support unit 110 by tightening first fixing bolts 115 while surrounding the fixing frames 20*a*.

Figure 7:
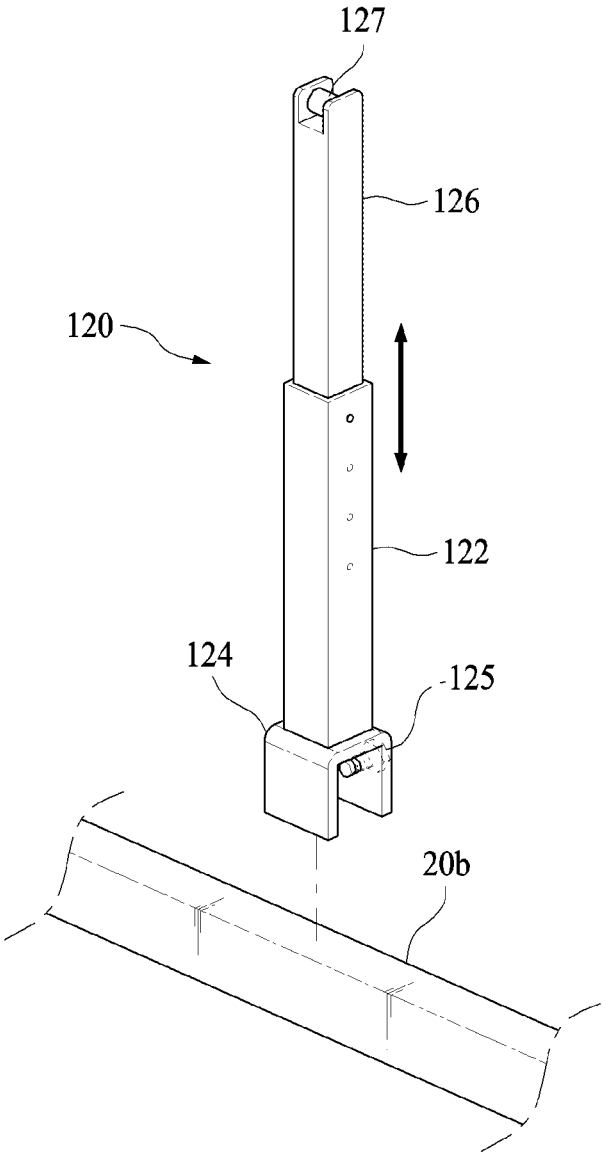
FIG. 7 is a perspective view illustrating a structure of an auxiliary fixing unit, in the body lifting device for a bed according to the first embodiment of the present invention.

FIG. 7 is a perspective view illustrating a structure of the auxiliary fixing unit 120, in the body lifting device for a bed according to the first embodiment of the present invention.

As illustrated in FIG. 7, in the present embodiment, the auxiliary fixing unit 120 is fixed to the movable part and has a predetermined height.

Further, in the present embodiment, the auxiliary fixing unit 120 has an adjustable height. In detail, the auxiliary fixing unit 120 includes a second base 122, a second slide 126 provided above the second base 122 to be vertically slidable with respect to the second base 122, a fixing part 127 provided above the second slide 126, to which the one end of the driving force transfer member is fixed, and a second connecting part 124 configured to fix the auxiliary fixing unit 120 to the movable part.

Here, the second connection part 124 is formed to surround the movable frames 20*b* of the movable part and is fixed to the entire auxiliary fixing unit 120 by tightening second fixing bolts 125 while surrounding the movable frames 20*b*.

Hereinabove, components of the body lifting device for a bed according to the first embodiment of the present invention will be described. The components of the present invention are not limited to the present embodiment and have any shape that may implement the corresponding functions.

Figure 8:
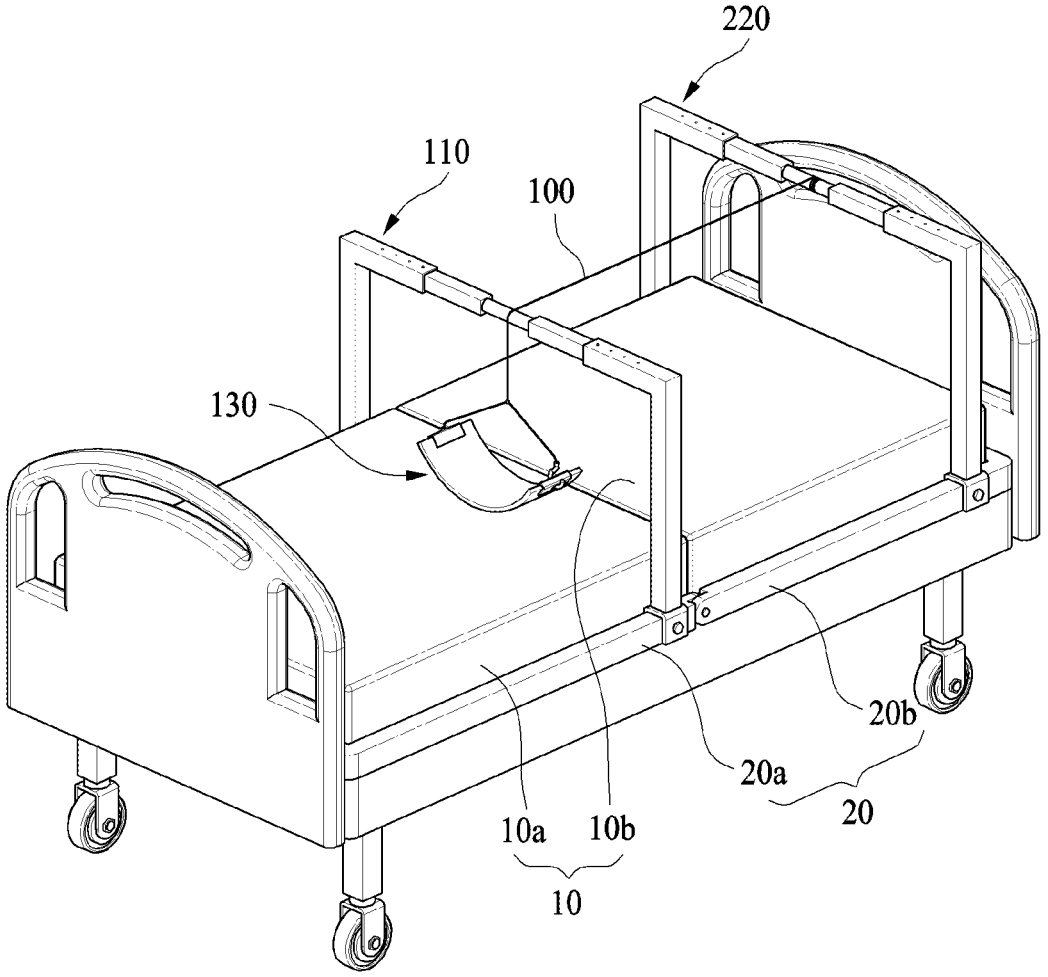
FIG. 8 is a perspective view illustrating a shape of a body lifting device for a bed according to a second embodiment of the present invention.

FIG. 8 is a perspective view illustrating a shape of a body lifting device for a bed according to a second embodiment of the present invention.

All components according to the second embodiment of the present invention illustrated in FIG. 8 are identical to those according to the above-described first embodiment, but has an auxiliary fixing unit 220 having a different shape.

In detail, the auxiliary fixing unit 220 according to the present embodiment has the same shape as that of the support unit 110 and is fixed to the movable frames 20*b*. Thus, in the present embodiment, the support unit 110 and the auxiliary fixing unit 220 may be mixedly used without discrimination.

Figure 9:
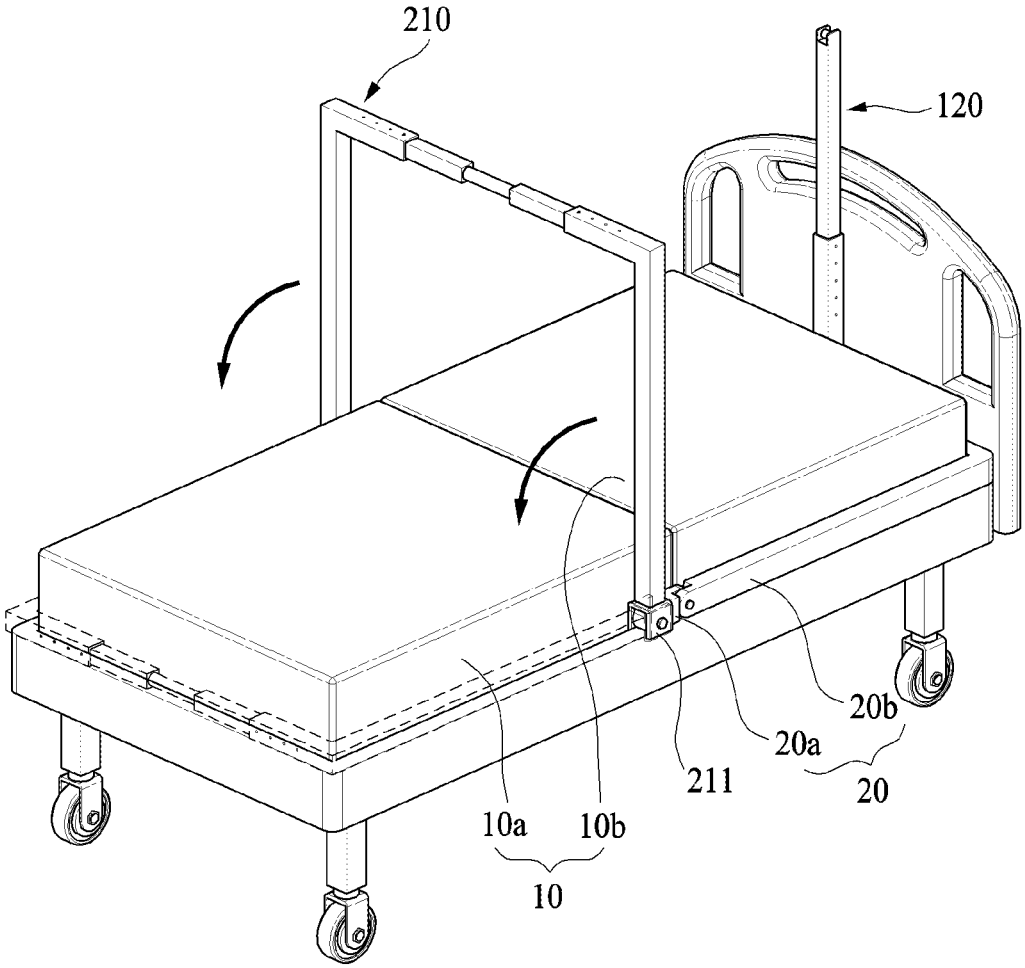
FIG. 9 is a perspective view illustrating a state in which a support unit is folded, in a body lifting device for a bed according to a third embodiment of the present invention.

FIG. 9 is a perspective view illustrating a state in which the support unit 210 is folded, in a body lifting device for a bed according to a third embodiment of the present invention.

As illustrated in FIG. 9, all components according to the third embodiment of the present invention are identical to those according to the above-described first embodiment, but the support unit 210 has a different structure.

In detail, in the present embodiment, the support unit 210 is rotatable with respect to the fixing part 10*a* and is foldable toward a circumference of the fixing part 10*a*.

That is, accordingly, when a body lifting operation of the user is not required, an inconvenient state in which the support unit 210 is changed to a folded state, and thus the body is caught by the support unit 210 may be prevented.

In particular, in the present embodiment, the support unit 210 may be rotated by hinges 211, but the present invention is not limited thereto. Further, a rotation structure may be implemented in various schemes.

Figure 10:
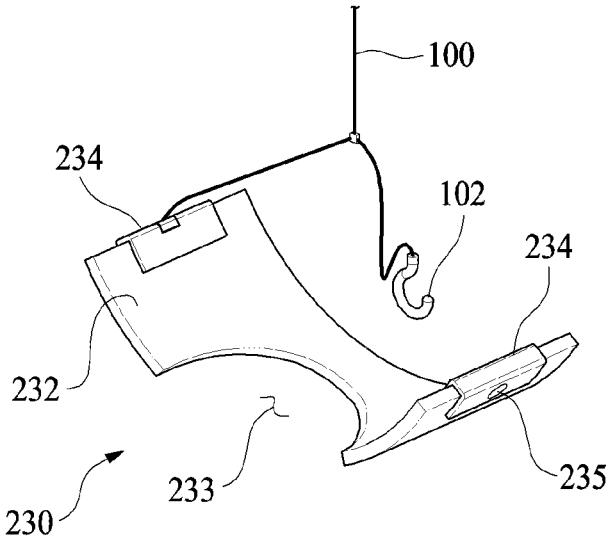
FIG. 10 is a perspective view illustrating a structure of a lifting unit, in a body lifting device for a bed according to a fourth embodiment of the present invention.

FIG. 10 is a perspective view illustrating a structure of the auxiliary fixing unit 230, in a body lifting device for a bed according to a fourth embodiment of the present invention.

Although the lifting unit 230 according to the fourth embodiment of the present invention, which is illustrated in FIG. 10, has substantially the same shape as that of the above-described lifting unit according to the first embodiment, there is a difference in that a support member 232 has an opened area 233 formed by opening an area corresponding to an anus of the body of the user.

That is, the present embodiment has an advantage in that the anus of the user is exposed in a state in which the body of the user is lifted up by the support member 232, so that excretions may be easily processed.

Figure 11:
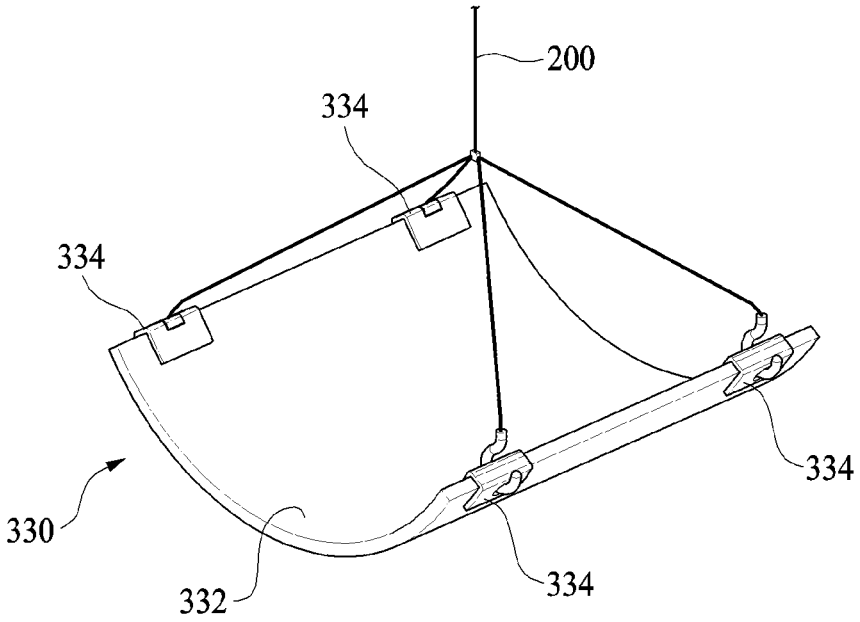
FIG. 11 is a perspective view illustrating a structure of a lifting unit, in a body lifting device for a bed according to a fifth embodiment of the present invention.

FIG. 11 is a perspective view illustrating a structure of the lifting unit 330, in a body lifting device for a bed according to a fifth embodiment of the present invention.

In the lifting unit 330 according to the fifth embodiment of the present invention, which is illustrated in FIG. 11, a front-rear length of a support member 332 is larger than those according to the above-described embodiments.

That is, in the present embodiment, the user may be lifted up while a wider area such as a back and portions of legs as well as the hip is supported. Further, in this way, in the present embodiment, as an area of the support member 332 is increased, the other end of the driving force transfer member 200 are branched into four parts, and the branched four parts are connected to fastening parts 334 formed at edges of the support member 332, respectively, so that the lifting unit 330 is stably balanced.

In this way, components of the present invention may be variously implemented without limitation of a shape.

Figure 12:
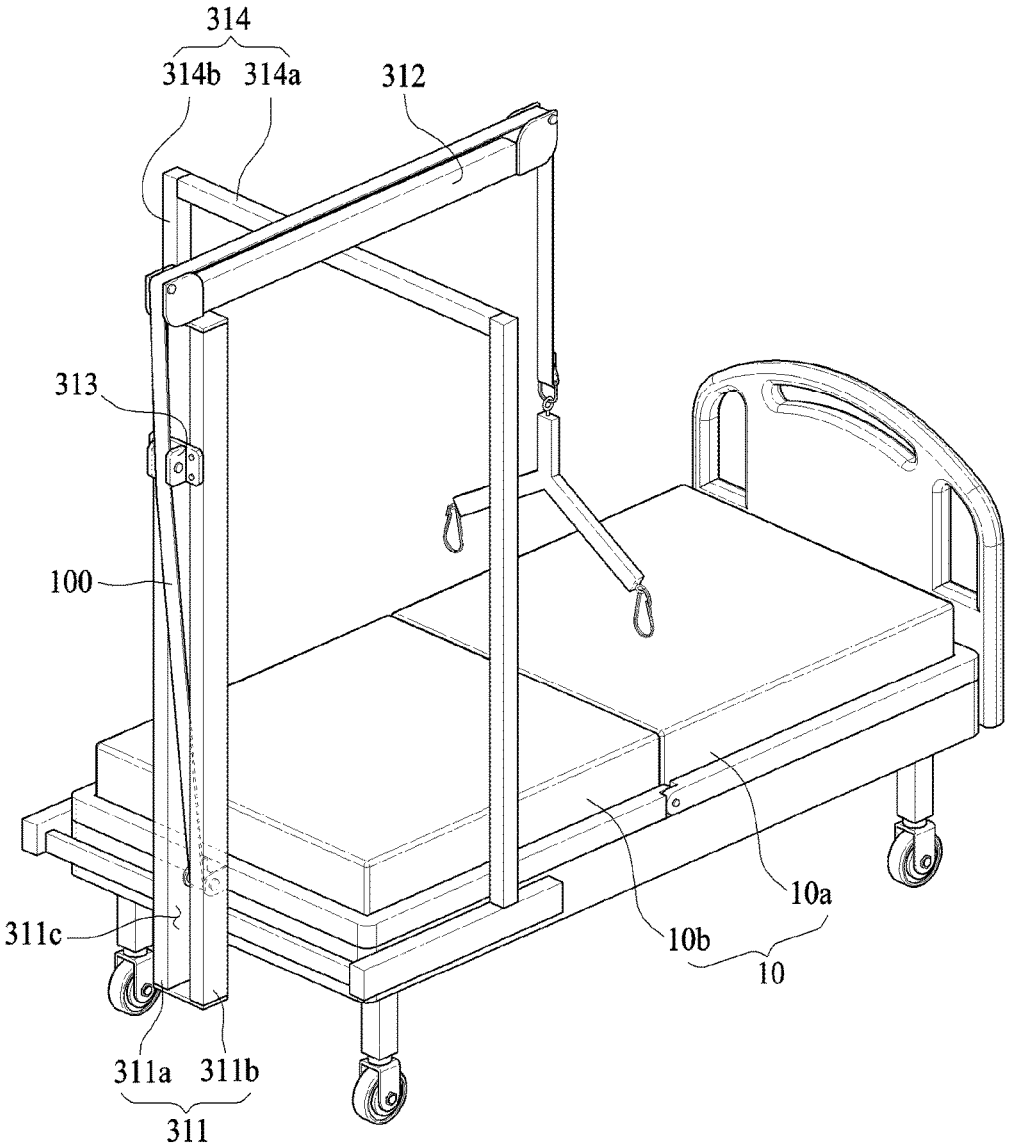
FIG. 12 is a perspective view illustrating a state in which a movable part of a body lifting device for a bed according to a sixth embodiment of the present invention is located on an upper side.
Figure 13:
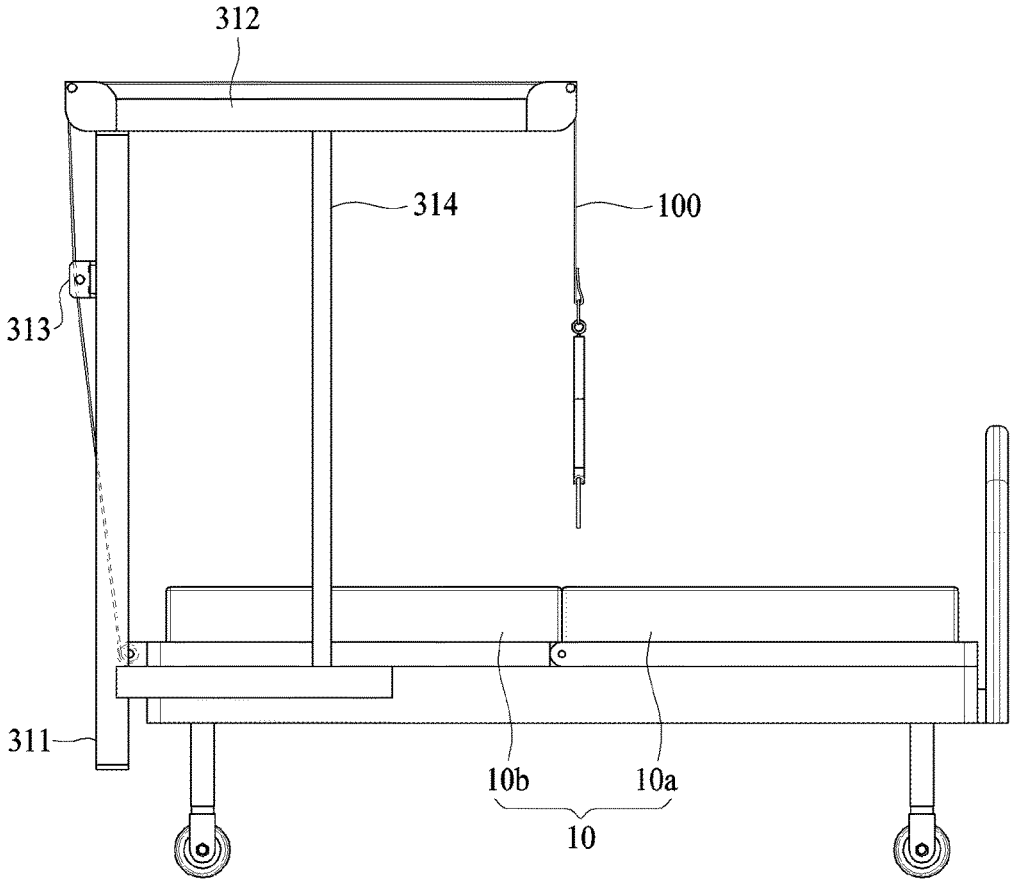
FIG. 13 is a side view illustrating a state in which the movable part of the body lifting device for a bed according to the sixth embodiment of the present invention is located on an upper side.
Figure 14:
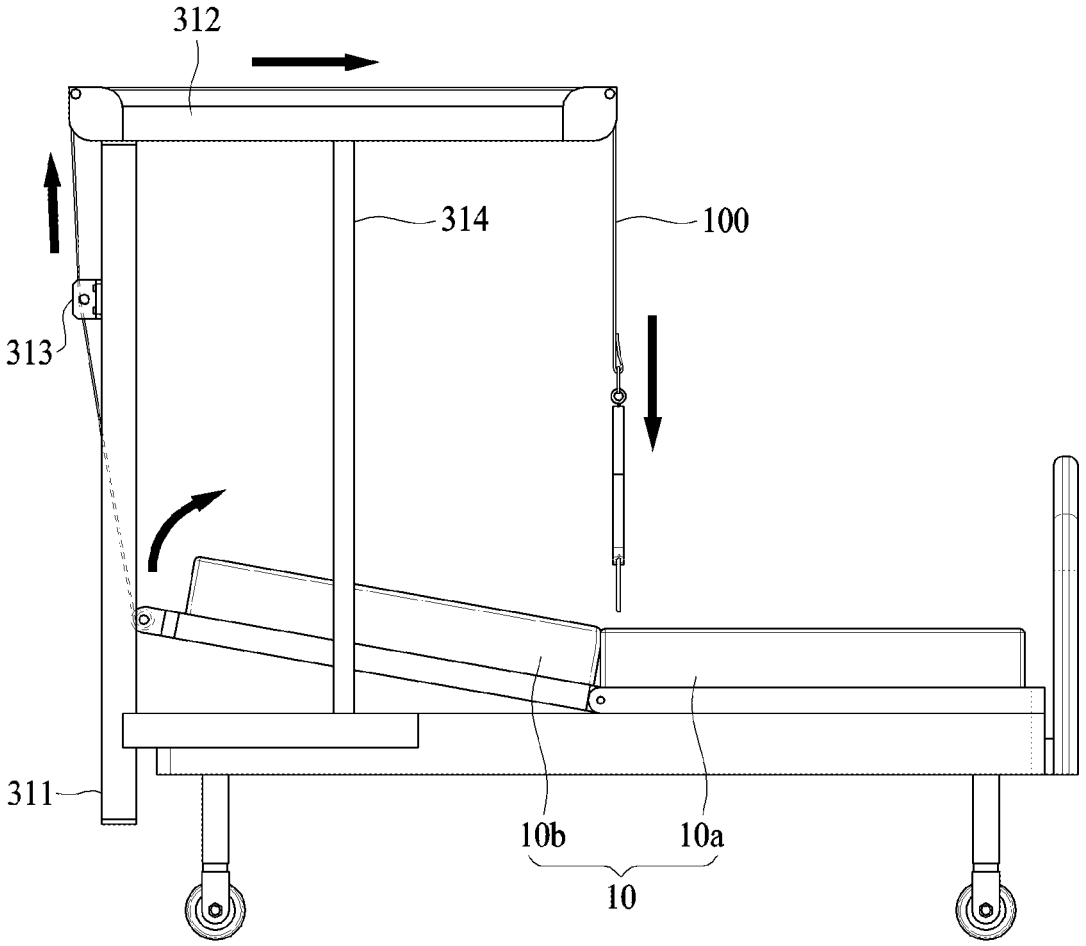
FIG. 14 is a view illustrating movement of a driving force transfer member when the movable part of the body lifting device according to the sixth embodiment of the present invention is located on an upper side.

FIG. 12 is a perspective view illustrating a state in which the movable part of the body lifting device for a bed according to a sixth embodiment of the present invention is located on an upper side, FIG. 13 is a side view illustrating a state in which the movable part of the body lifting device for a bed according to the sixth embodiment of the present invention is located on an upper side, and FIG. 14 is a view illustrating movement of the driving force transfer member when the movable part of the body lifting device for a bed according to the sixth embodiment of the present invention is located on an upper side.

Referring to FIG. 12, an entire structure and an operation according to the sixth embodiment of the present invention are similar to those according to the above-described embodiments. Hereinafter, a support unit 310 that is different from that according to the above embodiments will be mainly described.

The support unit 310 according to the present embodiment includes a vertical part 311, a horizontal part 312 and a movable part 313.

The vertical part 311 has a predetermined height and has an opening hole 311*c* formed therein. In detail, the vertical part 311 according to the present embodiment is arranged above the movable part 10*b* in which an upper body of a patient is located.

The opening hole 311*c* extends vertically. Thus, even when the movable part 313, which will be described below, is moved vertically, the driving force transfer member 100 may be in contact with the movable part 313 through the opening hole 311*c*.

Meanwhile, the opening hole 311*c* may be formed to pass through the vertical part 311 or may be formed variously. The vertical part 311 according to the present embodiment includes a first vertical part 311*a* and a second vertical part 311*b* spaced apart from the first vertical part 311*a* by a predetermined distance. Further, the opening hole 311*c* may be formed through a spaced space between the first vertical part 311*a* and the second vertical part 311*b*.

The horizontal part 312 is coupled to an upper portion of the vertical part and extends toward a rear side of the bed with respect to the vertical part 311. A length of the horizontal part 312 may be determined depending on a portion of a patient to be cared. Furthermore, when the length of the horizontal part 312 is adjustable, a location of the lifting unit may be changed depending on a body shape of the patient or a detailed location to be lifted up.

Further, in the present embodiment, the support unit 310 further includes a support part 314 configured to support the horizontal part 313. That is, when the patient is lifted up, the support part 314 serves to prevent the horizontal part 313 from being bent or damaged by a weight that is applied to the horizontal part 313.

That is, the support part 314 may be provided to have various structures that may effectively support the horizontal part 313, and in the present embodiment, the support part 314 includes a horizontal member 314*a* configured to support a lower portion of the horizontal part 313 and a pair of vertical members 314*b* configured to support both ends of the horizontal member 314*a*.

The movable part 313 may be provided in the vertical part 311 to be vertically movable. To movably install the movable part 313 in the vertical part 311, various structures including, for example, a structure in which a guide groove is installed in one of the vertical part 311 and the movable part 313 and a boss inserted into the guide groove is formed in the other one thereof may be adopted.

FIGS. 13 and 14 are views illustrating a case where the movable part 313 is located on an upper side. In detail, the movable part 313 is located higher than a height of a distal end of the movable part 10*b* that is rotatably provided. Accordingly, as identified in FIG. 14, when the movable part 10*b* is rotated upward, a distance between the movable part 313 and an end of the movable part 10*b* becomes smaller. Thus, the other end of the driving force transfer member 100 is moved downward through an end of the horizontal part 312 by a reduced distance.

Further, through a process that is opposite to the above, the patient is lifted up through the lifting unit while the other end of the driving force transfer member 100 is moved upward.

Consequently, when the movable part 313 is located higher than the end of the movable part 10*b*, if the movable part is rotated upward, the lifting unit is moved downward, and if the movable part is rotated downward, the lifting unit is moved upward.

Figure 15:
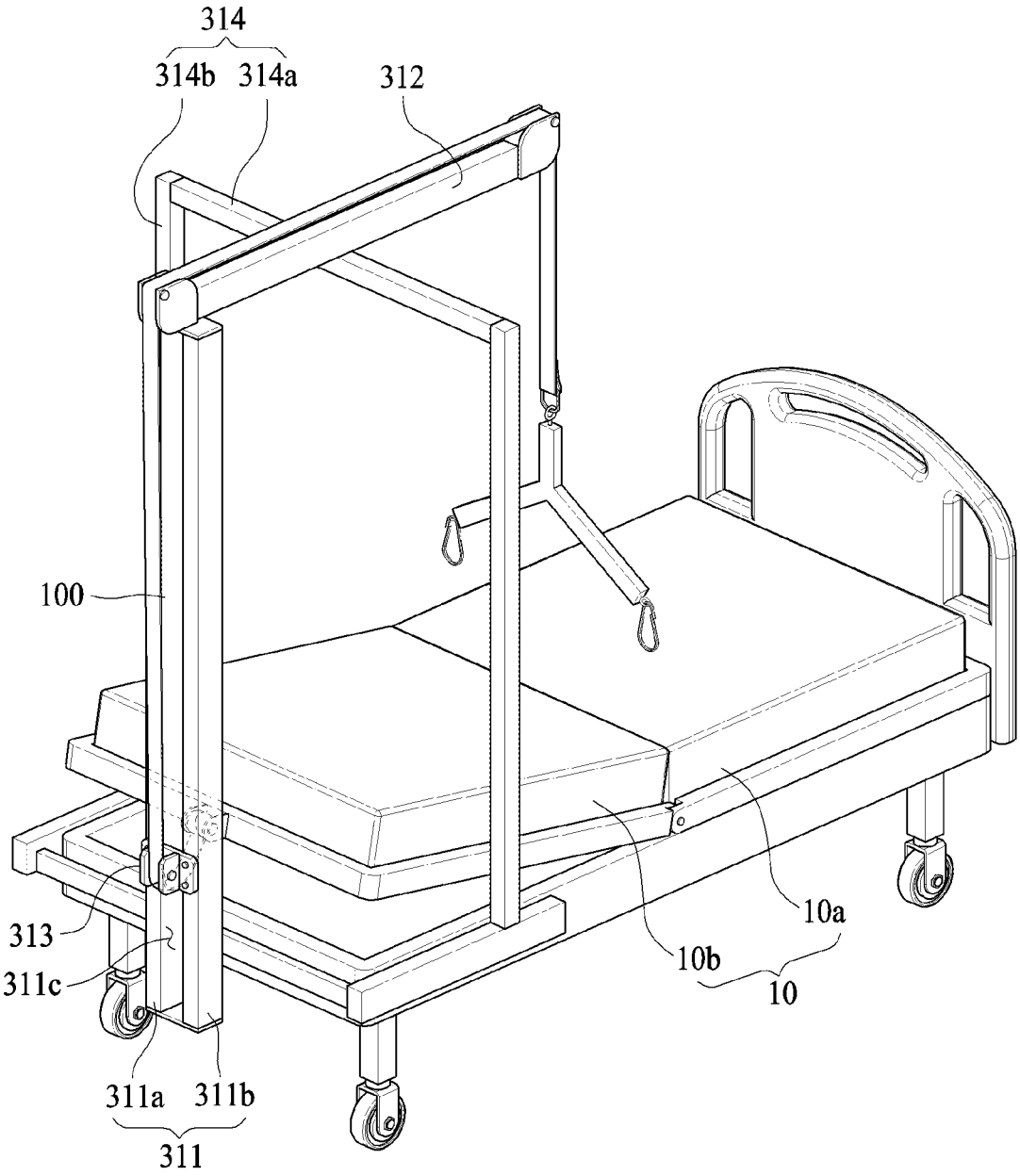
FIG. 15 is a perspective view illustrating a state in which the movable part of the body lifting device for a bed according to the sixth embodiment of the present invention is located on a lower side.
Figure 16:
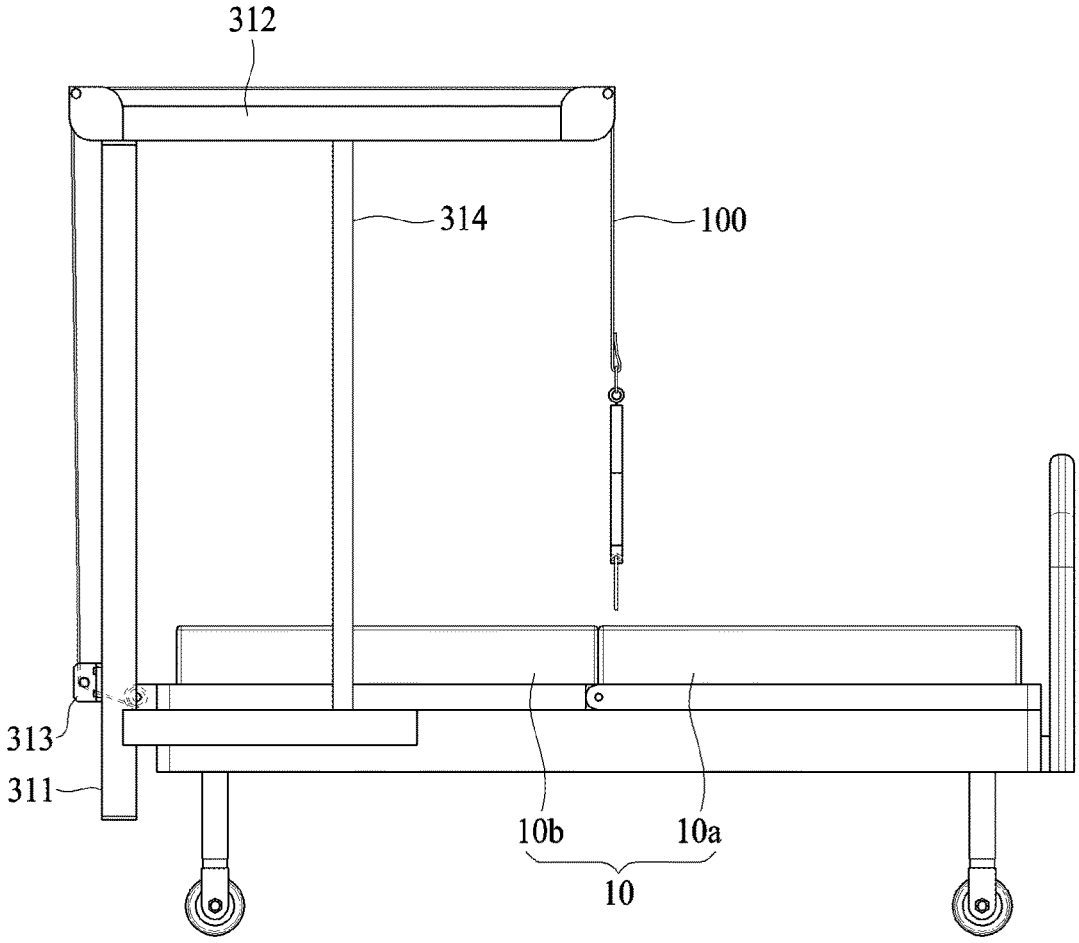
FIG. 16 is a side view illustrating a state in which the movable part of the body lifting device for a bed according to the sixth embodiment of the present invention is located on a lower side.
Figure 17:
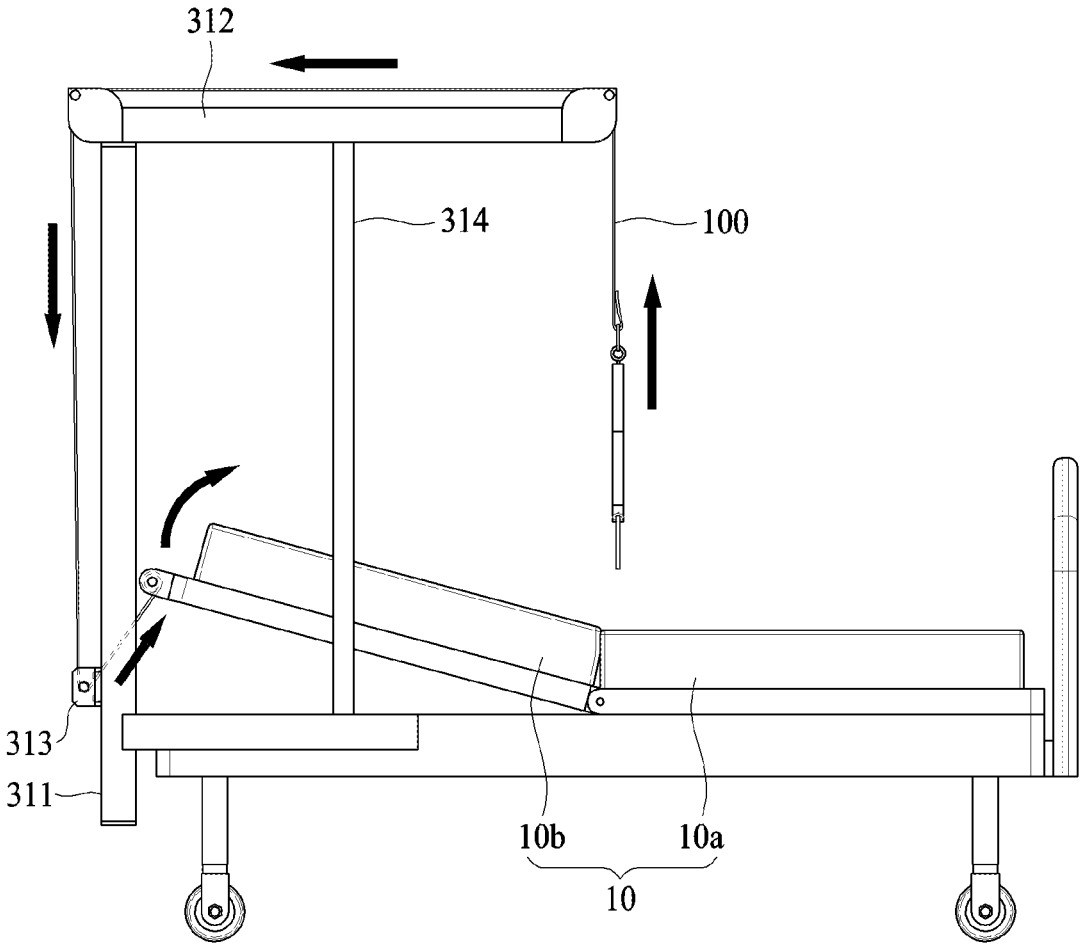
FIG. 17 is a view illustrating the movement of the driving force transfer member when the movable part of the body lifting device according to the sixth embodiment of the present invention is located on a lower side.

FIG. 15 is a perspective view illustrating a state in which the movable part of the body lifting device for a bed according to a sixth embodiment of the present invention is located on a lower side, FIG. 16 is a side view illustrating a state in which the movable part of the body lifting device for a bed according to the sixth embodiment of the present invention is located on a lower side, and FIG. 17 is a view illustrating movement of the driving force transfer member when the movable part of the body lifting device for a bed according to the sixth embodiment of the present invention is located on a lower side.

Referring to FIGS. 15 to 17, the movable part 313 may be fixed to a location lower than one end of the movable part 10*b*. In this case, when the movable part 10*b* is rotated upward, the distance between the movable part 313 and the end of the movable part 10*b* becomes larger. Thus, the other end of the driving force transfer member 100 is moved upward through the end of the horizontal part 312 by an increased distance.

That is, as opposite to a case where the above-described movable part is located on an upper side, when the movable part 10*b* is rotated upward, the lifting unit is moved to an upper side, and when the movable part 10*b* is rotated downward, the lifting unit is moved downward.

Consequently, in the present embodiment, as the location of the movable part 313 provided to be vertically movable is changed, a rotation direction of the lifting unit depending on the rotation of the movable part 10*b* may be selected. Thus, there is an advantage in that the patient may be effectively cared depending on a state of the patient.

Hereinabove, the exemplary embodiments of the present invention have described above. It is obvious to those skilled in the corresponding art that the present invention may be specified in different specific forms in addition to the above-described embodiments without departing from the purpose and the scope of the present invention. Therefore, the above-described embodiments are configured to be not restrictive but illustrative, and accordingly, the present invention is not limited to the above descriptions and may be changed within the scope and equivalents of the appended claims.

The invention claimed is:

1. A body lifting device for a bed, the body lifting device comprising:

a support unit connected to a fixing part of a bed comprising the fixing part and a movable part formed to adjust an angle between the fixing part and the movable part, and having a predetermined height;

a driving force transfer member having one end connected to the movable part, the other end extending toward the fixing part and a support point at which at least a portion between the one end and the other end of the driving force transfer member is supported by the support unit, wherein a length between the support point and the other end is varied depending on adjusting of an angle of the movable part; and a lifting unit formed to support at least a portion of a body of a user, connected to the other end of the driving force transfer member, and configured to selectively lift up the body of the user depending on movement of the driving force transfer member, which is caused by adjusting an angle of the movable part.

2. The body lifting device of claim 1, wherein the support unit comprises:

a pair of vertical bars provided at both sides of the fixing part, respectively, and extending vertically; and a horizontal bar configured to connect upper ends of the pair of vertical bars to each other and having a support point configured to support the driving force transfer member.

3. The body lifting device of claim 2, wherein the horizontal bar has an adjustable length.

4. The body lifting device of claim 3, wherein the horizontal bar comprises:

first bases; and first slides formed to be relatively slidable with respect to the first bases.

5. The body lifting device of claim 2, wherein the horizontal bar comprises a rotation part having the support point and formed rotatably.

6. The body lifting device of claim 1, wherein the support unit comprises a first connection part configured to fix the support unit to the fixing part.

7. The body lifting device of claim 1, further comprising an auxiliary fixing unit fixed to the movable part, having a predetermined height and connected to the one end of the driving force transfer member on an upper side of the auxiliary fixing unit.

8. The body lifting device of claim 7, wherein the auxiliary fixing unit has an adjustable length.

9. The body lifting device of claim 8, wherein the auxiliary fixing unit comprises:

a second base; and a second slide provided above the second base, formed to be vertically slidable with respect to the second base, and connected to the one end of the driving force transfer member at an upper end of the second slide.

10. The body lifting device of claim 7, wherein the auxiliary fixing unit comprises a second connection part configured to fix the auxiliary fixing unit to the movable part.

11. The body lifting device of claim 1, wherein the other end of the driving force transfer member is branched into two parts, and wherein the lifting unit comprises:

a support member having a predetermined area and configured to support at least a portion of the body of the user; and a pair of fastening parts formed at both ends of the support member and connected to the branched ends of the driving force transfer member.

12. The body lifting device of claim 11, wherein at least one of the pair of fastening parts is attached/detached to/from the branched ends of the driving force transfer member.

13. The body lifting device of claim 11, wherein the support member has an opened area formed by opening an area corresponding to an anus of the body of the user.

14. The body lifting device of claim 1, wherein the support unit is rotatably formed in the fixing part and is folded toward a circumference of the fixing part.

15. A body lifting device for a bed, the body lifting device comprising:

a support unit installed in a bed comprising a fixing part and a movable part formed to adjust an angle between the fixing part and the movable part, and comprising a vertical part having a predetermined height and having an opened hole extending vertically, a horizontal part coupled to an upper portion of the vertical part, and a movable part provided in the vertical part to be vertically movable;

a driving force transfer member having one end connected to the movable part and being in contact with the movable part by passing through the opened hole and having a support point supported by the horizontal part, wherein a length between the support point and the other end is varied depending on adjusting of an angle of the movable part; and a lifting unit formed to support at least a portion of a body of a user, connected to the other end of the driving force transfer member, and configured to selectively lift up the body of the user depending on movement of the driving force transfer member, which is caused by adjusting the angle of the movable part.

16. The body lifting device of claim 15, further comprising a support part configured to support the horizontal part.

17. The body lifting device of claim 15, wherein the vertical part comprises a first vertical part and a second vertical part spaced apart from the first vertical part by a predetermined distance to define an opened hole between the first vertical part and the second vertical part.

* * * * *